US008258712B1

(12) United States Patent
Xiong et al.

(10) Patent No.: US 8,258,712 B1
(45) Date of Patent: Sep. 4, 2012

(54) BALLAST CIRCUIT FOR REDUCING LAMP STRIATIONS

(75) Inventors: Wei Xiong, Madison, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 507 days.

(21) Appl. No.: 12/494,177

(22) Filed: Jun. 29, 2009

Related U.S. Application Data

(60) Provisional application No. 61/083,728, filed on Jul. 25, 2008.

(51) Int. Cl.
*H05B 37/02* (2006.01)

(52) U.S. Cl. ..... 315/224; 315/291; 315/307

(58) Field of Classification Search ..... 315/247, 315/224, 225, 246, 291, 307–311
See application file for complete search history.

(56) References Cited

U.S. PATENT DOCUMENTS 5,001,386 A 3/1991 Sullivan et al.
5,173,643 A 12/1992 Sullivan et al.
5,192,896 A 3/1993 Qin
5,596,247 A 1/1997 Martich et al.
5,691,606 A 11/1997 Moisin et al.
5,729,095 A 3/1998 Shimokawa et al.
5,760,541 A 6/1998 Stavely et al.
5,798,617 A 8/1998 Moisin
5,821,699 A 10/1998 Moisin
5,841,239 A 11/1998 Sullivan et al.
5,864,212 A * 1/1999 Sullivan ..... 315/205
5,955,841 A 9/1999 Moisin et al.
5,961,204 A 10/1999 Martich et al.
5,982,111 A 11/1999 Moisin
5,994,843 A 11/1999 Kataoka et al.
6,400,097 B1 6/2002 Jin et al.
6,465,972 B1 10/2002 Kachmarik et al.
6,677,716 B2 * 1/2004 Rudolph et al. ..... 315/224
6,756,747 B2 6/2004 Hsieh
6,836,077 B2 12/2004 Nerone
6,963,176 B2 11/2005 Onishi et al.
7,679,294 B1 * 3/2010 Xiong et al. ..... 315/224

* cited by examiner

*Primary Examiner* — James H Cho
(74) *Attorney, Agent, or Firm* — Waddey & Patterson, P.C.; Mark J. Patterson

(57) ABSTRACT

An electronic ballast circuit includes a striation reduction circuit that can create an asymmetry in a lamp power signal that powers a gas-discharge lamp. The striation reduction circuit may have first and second circuit paths to cause the asymmetry in the lamp power signal. The first circuit path transmits the AC component signal of an input signal associated with an AC voltage while the second circuit path transmits a DC component signal. A non-linear component in the second circuit path is utilized to generate a harmonic component signal. AC component signal, DC component signal, and harmonic component signal are superimposed onto one another to cause an asymmetry in the lamp power signal that powers the gas discharge lamp.

15 Claims, 5 Drawing Sheets

BALLAST CIRCUIT FOR REDUCING LAMP STRIATIONS

CROSS-REFERENCES TO RELATED APPLICATIONS

This is a non-provisional U.S. patent application that claims the benefit of provisional U.S. Patent Application 61/083,728 filed on Jul. 25, 2008.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

Many conventional electronic ballast circuits provide lamp power signals that cause lamp striations during the operation of the gas-discharge lamp. Lamp striations are zones of light intensity that appear as dark bands and may cause the lamp to operate with an undesirable strobing effect.

There are two known ways of reducing lamp striations. The first is to perform lamp current amplitude modulation. The disadvantage of this technique is that it requires complex and costly electronic circuits. The other method is to create an asymmetrical lamp power signal by superimposing a DC component signal onto the lamp power signal. Prior art ballast circuits accomplish this by manipulating inverter switch devices in the ballast circuit. For example, the inverter switch devices in the ballast circuit may be switched at asymmetrical switch frequencies. While this technique is effective in creating an asymmetrical lamp power signal, operating the inverter switch devices at asymmetrical switch frequencies may cause unnecessary harmonic distortion in the ballast circuit.

What is needed is a ballast circuit that reduces lamp striations in a more efficient manner without utilizing complicated electronic circuits that increase the cost of the ballast.

BRIEF SUMMARY OF THE INVENTION

This invention is directed to a ballast circuit that utilizes a striation reduction circuit to reduce lamp striations when powering a gas-discharge lamp. The ballast circuit may include an inverter with inverter switch devices that convert a DC voltage into a periodic voltage signal. A resonant circuit filters the periodic voltage signal to provide the required AC lamp voltage. This AC voltage may be utilized by the striation reduction circuit to generate a lamp power signal that reduces lamp striations during the operation of the gas-discharge lamp. Expensive electronic components are not required by the ballast circuit and the striation reduction circuit does not create unnecessary harmonic distortion in the inverter.

The striation reduction circuit has a first circuit path and a second circuit path. An input signal associated with the AC signal is received by the first circuit path and may have a DC component signal and an AC component signal. The first circuit path has a DC blocking component that blocks the DC component signal and passes the AC component signal. The second circuit path transmits the DC component signal and a low frequency signal which may be from the AC voltage. The second circuit path may then utilize the DC component signal to generate a DC offset signal that is superimposed on the AC component signal from the first circuit path. This causes the lamp power signal to be asymmetrical.

To improve the efficiency of the ballast circuit, a non-linear component is included in the second circuit path. The non-linear component may be a diode that has a non-linear response to the low frequency signal. This non-linear response generates a harmonic component signal with increased harmonic complexity. The harmonic component signal is also superimposed onto AC component signal which allows ballast circuit to operate at greater efficiency.

BRIEF DESCRIPTION OF THE SEVERAL VIEWS OF THE DRAWINGS

FIG. 4(*b*) is a graphical representation of the frequency domain characteristics of one example of the DC offset and the harmonic component signal generated by the second circuit path of the striation reduction circuits in FIGS. 1 and 2.

DETAILED DESCRIPTION OF THE INVENTION

Figure 1:
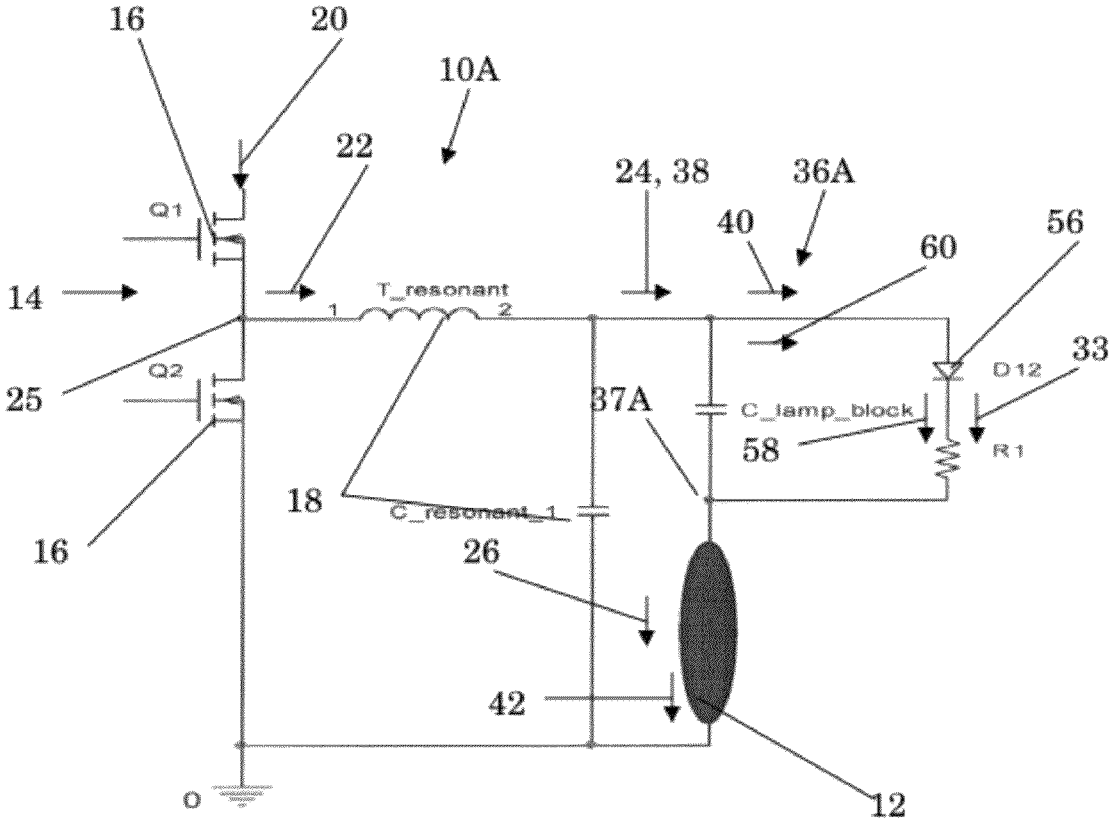
FIG. 1 is a schematic of a first embodiment of a ballast circuit with a striation reduction circuit in accordance with the present invention.
Figure 2:
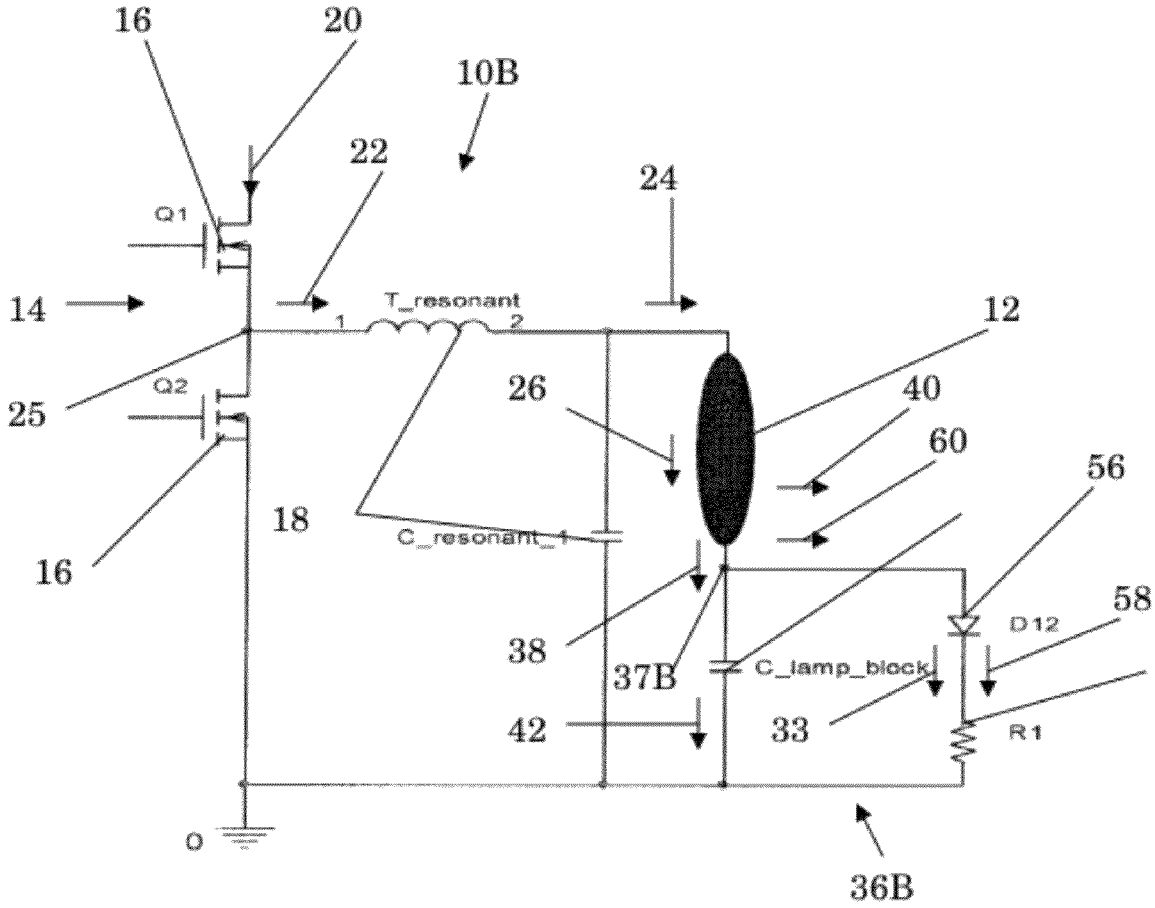
FIG. 2 is a schematic of a second embodiment of a ballast circuit with a striation reduction circuit in accordance with the present invention.

Referring now to FIG. 1 and FIG. 2, two embodiments of ballast circuits 10A, 10B for powering a gas-discharge lamp 12 in accordance with the invention are shown. Each ballast circuit 10A, 10B has an inverter 14 that receives a DC voltage 20 from a DC voltage source (not shown). The DC voltage source may be an independent DC source such as a battery or the like, an AC to DC converter in ballast circuit 10A, 10B that converts an AC line signal from a power line into the DC voltage 20, or any other type of power source that generates a DC signal.

As is known in the art, inverter 14 utilizes inverter switch devices 16 to generate a periodic signal 22 from the DC voltage 20. A control circuit (not shown) determines the switch frequency of inverter switch devices 16 and thus the characteristics of periodic signal 22. A resonant circuit 18 filters the periodic signal 22 to provide an AC voltage 24 at the appropriate frequency for powering the gas discharge lamp 12. In this particular embodiment, the resonant circuit 18 is a series resonant circuit and is coupled between the inverter switch devices 16 at terminal 25. Inverter switch devices 16 are controlled by a drive circuit (not shown) that controls the switch frequency of the inverter switch devices 16.

The circuits described above are examples of one inverter topology that may be utilized with the invention. There are many different inverter topologies that can be utilized to power one or more gas discharge lamps. While the present invention does require an apparatus for converting a DC signal into an AC signal, the invention is not limited to any particular inverter topology as this feature is not critical to the invention.

Figure 3:
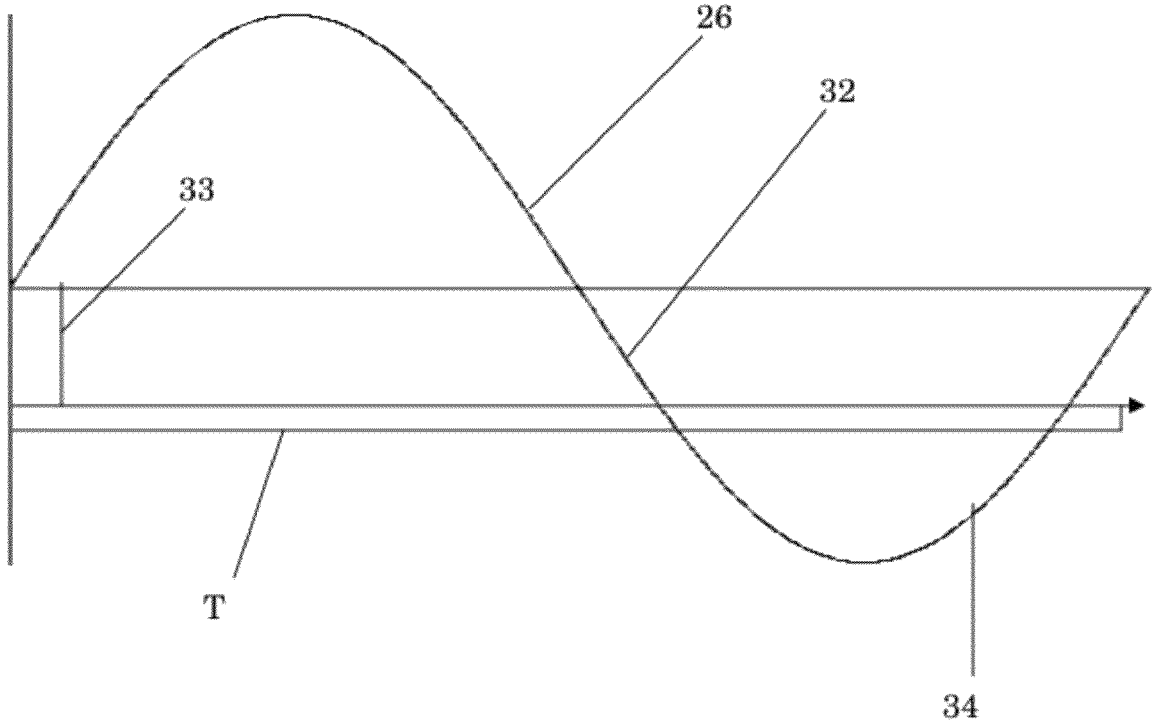
FIG. 3 is a graphical representation of one example of an asymmetrical lamp power signal that may be generated by the striation reduction circuits shown in FIGS. 1 and 2.

Referring now to FIGS. 1, 2, and 3, inverter 14 and striation reduction circuits 36A, 36B create an asymmetrical lamp power signal 26 that powers the gas-discharge lamp 12. These asymmetrical characteristics reduce lamp striations in the lamp power signal 26 during the operation of the ballast circuits 10A, 10B. Lamp power signal 26 may be asymmetrical either because the lamp power signal 26 has no axis of symmetry or because the lamp power signal 26 has an axis of symmetry that is offset from a reference voltage to a steady state voltage.

In the example shown in FIG. 3, lamp power signal 26 repeats every period T and has a positive cycle 32 that is longer than its negative cycle 34. Consequently, the axis of symmetry for this lamp power signal 26 is a positive DC offset 33. This asymmetry in the lamp power signal 26 reduces lamp striations during the operation of the ballast circuits 10A, 10B.

The embodiments shown in FIG. 1 and FIG. 2 each have striation reductions circuits 36A, 36B that reduce lamp striations. The striation reduction circuits 36A, 36B in the illustrated embodiments are identical except as to their respective locations in ballast circuits 10A, 10B. The striation reduction circuit 36A in FIG. 1 is coupled to terminal 37A of the gas-discharge lamp 12 while the striation reduction circuit 36B in FIG. 2 is coupled to terminal 37B of gas-discharge lamp 12.

Striation reduction circuits 36A, 36B form part of the load that receives power from the inverter 14. By forming part of the load of the inverter 14, striation reductions circuits 36A, 36B can affect the symmetry of the lamp power signal 26 that powers the gas-discharge lamp 12. In other embodiments, the striation reduction circuits 36A, 36B may be coupled to other components of a ballast circuit so long as the striation reduction circuits 36A, 36B have the capability of affecting the symmetry of the lamp power signal 26 that powers the gas-discharge lamp 12.

Striation reduction circuits 36A, 36B receive an input signal 38 associated with the AC voltage 24. In the embodiment of FIG. 1, the input signal 38 to circuit 36A is the AC voltage 24 itself while in FIG. 2 the input signal 38 is from the terminal 37B of the gas discharge lamp 12. As mentioned above, circuits 36A, 36B may be in other locations and thus input signal 38 may have any type of association with the AC voltage 24 so long as striation reduction circuits 36A, 36B are capable of affecting the symmetry of the lamp power signal 26.

Figure 4A:
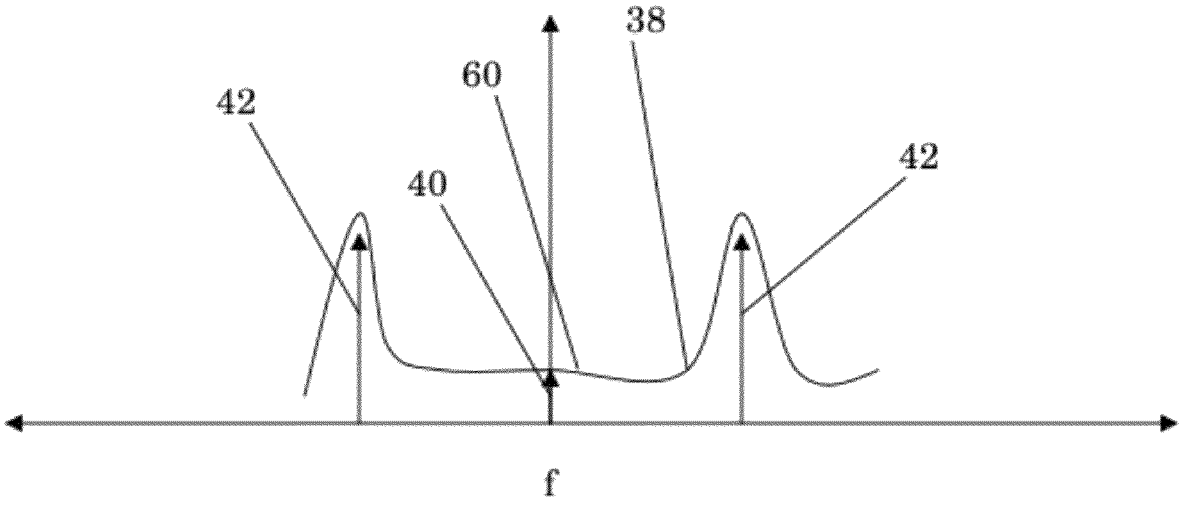
FIG. 4(*a*) is a graphical representation of the frequency domain characteristics of one example of an input signal that may be received by the striation reduction circuits shown in FIGS. 1 and 2.
Figure 4B:
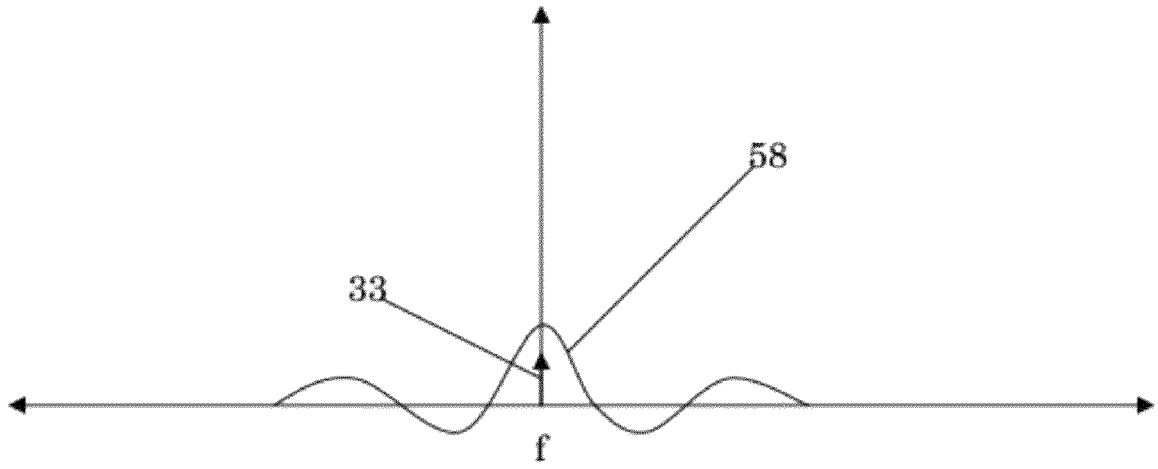

As shown in FIG. 4(*a*), input signal 38 is composed of an AC component 42 and a DC component 40. The component signals 40, 42 are depicted as a perfect DC and AC signals in the frequency domain. However, DC component signal 40 may also include periodic signals with a long enough period in comparison with the AC component signal 42 to allow striation reduction circuits 36A, 36B to reduce lamp striations. DC offset 33 may thus also vary slowly in comparison with the period of the AC component signal 42.

Similarly, AC component signal 42 in this embodiment operates at a single discrete frequency. It should be understood however that the invention is not limited to an AC component signal 42 that operates at a single discrete frequency but may have multiple AC component signals 42, either continuous or discrete. Such frequency domain characteristics may vary in accordance with requirements and electronic components of the ballast circuits.

Input signal 38 may have both an AC component 42 and a DC component 40. One method of providing this type of input signal 38 is to not include a DC filter between the inverter switch devices 16 and the resonant circuit 18. In this manner, AC voltage 24 includes the AC component signal 42 and the DC component signal 40 which is then transmitted by the input signal 38.

Referring again to FIGS. 1 and 2, striation reduction circuits 36A, 36B may have at least two circuit paths 44, 52 which in the illustrated embodiments are connected in parallel. These striation reduction circuits 36A, 36B receive input signal 38. First circuit path 44 includes a DC blocking component 46 which in these embodiments is a capacitor. DC blocking component 46 passes the AC component signal 42 but blocks the DC component signal 40. The second circuit path 52 transmits the DC component signal 42. A resistor 48 may be included in the second circuit path 52. The resistor 48 determines the level of the DC offset 33 which is output from the second circuit path 52. Because the first circuit path 44 and the second circuit path 52 are in parallel, the DC offset 33 is superimposed on the AC component signal 42. This DC offset 33 thus determines the displacement of the axis of symmetry of AC component signal 42 from a reference voltage such as 0 volts. DC offset 33 thereby displaces the axis of symmetry of AC component signal 42 which thereby causes AC component signal 42 to be asymetrical.

In the embodiments of FIGS. 1, 2, and 4(*a*) and 4(*b*), the DC offset 33 may be expressed in terms of a DC lamp current level equal to one-half the DC voltage 20 divided by the sum of the resistance of resistor 48 and the resistance of the gas-discharge lamp 16. To add harmonic richness to the lamp power signal 26, second circuit path 52 may also have a non-linear component 56 utilized to create a harmonic component signal 58. Non-linear component 56 may be any type of component that reacts in a non-linear fashion to the phase or amplitude of a signal associated with the lamp power signal 26. In both of the illustrated embodiments, the non-linear component 56 is a forward-biased diode 56.

Referring now specifically to FIGS. 1, 4(*a*) and 4(*b*), a first embodiment of the ballast circuit 10A is shown with a striation reduction circuit 36A coupled to gas-discharge lamp 12. The input signal 38 in this embodiment is the AC voltage 24 itself. The AC component signal 42 of the AC voltage 24 is coupled via the first circuit path 44 and a low frequency signal 60 of the AC voltage 24 and the DC component signal 40 are coupled via the second circuit path 52.

The forward-biased diode 56 is non-linear because it transmits the low frequency signal 60 during its positive half-cycle but blocks the low frequency signal 60 during the negative half-cycle. In turn, this generates a harmonic component signal 58 that has a rich frequency spectrum with frequencies that are lower than the frequency spectrum of the AC voltage 24. The harmonic component signal 60 and the DC offset 33 are then superimposed onto the AC component signal 42 so as to generate the lamp power signal 26. Lamp power signal 26 is then input into input terminal 37A to power the gas-discharge lamp 12.

Referring now specifically to FIGS. 2, 4(*a*) and 4(*b*), a second embodiment of the ballast circuit 10B is shown with a striation reduction circuit 36B coupled to gas-discharge lamp 12. The input signal 38 in this embodiment is the AC voltage 24 minus the lamp power signal 26 and is received from the output terminal 37B. The AC component signal 42 of the input signal 38 is coupled via the first circuit path 44 and a low frequency signal 60 of the input signal 38 and the DC component signal 40 are coupled via the second circuit path 52. The forward-biased diode 56 transmits the low frequency signal 60 during its positive half-cycle but blocks the low frequency signal 60 during the negative half-cycle. In turn, this generates the harmonic component signal 58 with a frequency spectrum at frequencies that are lower than the frequency spectrum of the AC voltage 24. The harmonic component signal 60 and the DC offset 33 are then superimposed onto the AC component signal 42 to consume a portion of the AC voltage 24. Because the gas-discharge lamp 12 and the striation reduction circuit 36B are coupled in series, the harmonic component signal 60 and the DC offset 33 are superimposed on the lamp power signal 26.

Striation reduction circuits 36A, 36B allow asymmetries to be created in the lamp power signal 26 without having to manipulate the switch frequency of inverter switch devices 16. Thus, inverter 14 may operate at a 50% duty cycle and the AC voltage 24 may be symmetrical. Striation reduction circuits 36A, 36B, are then utilized to create the asymmetry in the lamp power signal 26. Not having to manipulate the switch frequency of inverter switch devices 16 reduces harmonic distortion in the ballast circuits 10A, 10B.

Thus, although there have been described particular embodiments of the present invention of a new and useful BALLAST CIRCUIT FOR REDUCING LAMP STRIATIONS it is not intended that such references be construed as limitations upon the scope of this invention except as set forth in the following claims.

What is claimed is:

1. A ballast circuit for a gas discharge lamp comprising:

an inverter operable to convert a DC voltage into an AC voltage;

a striation reduction circuit coupled to the inverter to receive an input signal associated with the AC voltage, the input signal having a DC component signal and an AC component signal, the striation reduction circuit further comprising:

a first circuit path having a DC blocking component that blocks the DC component signal and transmits the AC component signal; and a second circuit path including a nonlinear component responsive to generate a harmonic component signal from the input signal, the second circuit path being operably associated with the first circuit path to superimpose a DC offset associated with the DC component signal and the harmonic component signal on the AC component signal, the second circuit path further comprises a diode that closes the second circuit path during a portion of a period of a low frequency signal associated with the input signal and opens the second circuit path during a different portion of the period of the low frequency signal associated with the input signal.

2. The ballast circuit of claim 1, wherein the DC blocking component comprises a DC blocking capacitor.

3. The ballast circuit of claim 1, wherein the first and second circuit paths are connected in parallel.

4. The ballast circuit of claim 1, wherein the inverter further comprises:

inverter switch devices operating at a substantially symmetrical switch frequency; and a resonant circuit tuned to provide the AC voltage.

5. The ballast circuit of claim 1, wherein the harmonic component signal is at a lower frequency than the AC component signal.

6. The ballast circuit of claim 5, wherein an asymmetrical lamp power signal associated with the AC signal component is generated to power the gas-discharge lamp.

7. The ballast circuit of claim 1, wherein the inverter is operable to generate the AC voltage to include the AC voltage component and the DC voltage component.

8. A ballast circuit for powering a gas discharge lamp, comprising:

an inverter operable to convert a DC voltage into an AC voltage, the AC voltage having a DC component signal and an AC component signal;

a striation reduction circuit responsive to the AC voltage so that a DC offset associated with the DC component signal and a harmonic component signal associated with the AC voltage is superimposed on the AC component signal thereby creating an asymmetrical lamp power signal that reduces lamp striations; and the striation reduction circuit further comprising a first circuit path having a DC blocking component that blocks the DC component signal and transmits the AC component signal; and a second circuit path operably associated with the first circuit path to superimpose a DC offset associated with the DC component signal and a low frequency signal associated with the AC voltage onto the AC component signal, the second circuit path comprising a biased component operable to transmit the DC component signal and to transmit a portion the low frequency signal and block a portion of the low frequency signal.

9. The ballast circuit of claim 8 wherein the biased component comprises a diode.

10. The ballast circuit of claim 8, wherein the second circuit path further comprises a resistor coupled to determine a degree of asymmetry of the asymmetrical lamp power signal.

11. The ballast circuit of claim 8, wherein the asymmetrical lamp power signal is generated to have a first power signal cycle slightly longer than a second power signal cycle.

12. The ballast circuit of claim 11, wherein the first and second circuit paths are connected in parallel.

13. A method of generating a lamp power signal that reduces lamp striations when powering a gas-discharge lamp comprising:

converting a DC voltage into an AC voltage;

receiving an input signal associated with the AC voltage, the input signal having an AC component signal and a DC component signal;

transmitting the AC component signal;

transmitting a DC offset signal associated with the DC component signal;

superimposing the DC offset signal onto the AC component signal to generate a lamp power signal that reduces lamp striations;

superimposing a harmonic component signal associated with the AC voltage on the AC component signal;

transmitting a low frequency signal with the DC component signal;

converting the low frequency signal onto a harmonic component signal; and superimposing the low frequency signal onto the AC component signal.

14. The method of claim 13, wherein the lamp power signal is asymmetrical.

15. The method of claim 13, wherein the AC voltage is substantially symmetrical.

* * * * *